US006783355B2

(12) United States Patent
Blaauwwiekel

(10) Patent No.: US 6,783,355 B2
(45) Date of Patent: Aug. 31, 2004

(54) METHOD FOR OPERATING A GAS BURNER

(75) Inventor: Piet Blaauwwiekel, Sleen (NL)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 09/937,732

(22) PCT Filed: Jan. 8, 2001

(86) PCT No.: PCT/EP01/00126

§ 371 (c)(1),
(2), (4) Date: Jun. 6, 2003

(87) PCT Pub. No.: WO01/55643

PCT Pub. Date: Aug. 2, 2001

(65) Prior Publication Data

US 2004/0009442 A1 Jan. 15, 2004

(51) Int. Cl.[7] ..... F23Q 23/00
(52) U.S. Cl. ..... 431/25; 431/75; 340/579
(58) Field of Search ..... 431/25, 75, 68, 431/79, 80; 340/579

(56) References Cited

U.S. PATENT DOCUMENTS 5,803,047 A * 9/1998 Rask ..... 123/406.37
5,899,683 A * 5/1999 Nolte et al. ..... 431/25
5,924,859 A * 7/1999 Nolte et al. ..... 431/12

FOREIGN PATENT DOCUMENTS

| | | | |
|---|---|---|---|
| DE | 19831648 | A | 1/2000 |
| EP | 0962703 | A | 12/1999 |
| GB | 2286038 | A | 8/1995 |

* cited by examiner

*Primary Examiner*—Alfred Basichas

(57) ABSTRACT

According to the invention, the ionization signal is detected at a first point of time during full-load operation and during partial-load operation, and for this first point of time a first difference is formed between the ionization signal during full-load operation and the ionization signal during partial-load operation. Furthermore, the ionization signal is detected at a second point of time during full-load operation and during partial-load operation, and for this second point of time a second difference is formed between the ionization signal during full-load operation and the ionization signal during partial-load operation. The first difference and the second difference are compared to each other and, dependent thereon, the state of the gas burner is inferred.

19 Claims, No Drawings

METHOD FOR OPERATING A GAS BURNER

The invention relates to a method for operating a gas burner according to the preamble of claim 1.

Gas burners normally comprise an electric or electronic ignition means and a flame monitoring means which normally measures an ionization current induced by the burner flame and, dependent on this ionization current, indicates the presence or absence of the burner flame.

There also exist controllers for gas burners which use the ionization current for guaranteeing a high combustion quality. In order to ensure an optimum and complete combustion of the fuel, i.e. the gas, within the gas burner, the latter has to be provided with an appropriately balanced gas/air mixture. For instance, the prior art discloses control methods using an ionization signal of a sensor projecting into the burner flame for adapting the gas/air mixture to, e.g., different gas qualities thereby adapting the gas/air mixture to the quality of the gas provided by the gas supply and guaranteeing a high combustion quality in the end. With respect to this, it can be referred to the DE-A-44 33 425, DE 39 37 290 A1, as well as the DE 195 39 568 C1.

In the known methods for operating a gas burner in which an ionization signal is used, there does, however, arise the problem that with increasing operating duration, the ionization signal provided by a sensor becomes unreliable. Then, a reliable information on the combustion conditions actually prevailing in the burner is no longer possible.

Proceeding from this, the present invention is based on the problem of providing a new method for operating a gas burner.

In accordance with the invention, the problem is solved by a method comprising the features of claim 1.

Preferred further developments of the invention are contained in the subclaims and the description.

The method according to the invention is based on the finding that the sensor supplying the ionization signal ages during the burner operation as a result of dirt deposited on the sensor. Further aging phenomena of the sensor may occur due to chemical decomposition or the like. In the case of such an aging, the signal of the ionization sensor is no longer reliable, since the electric behavior of the sensor changes.

The idea according to the invention is based on the further finding that each burner has a specific characteristic of the ionization current over the modulation area of the gas burner. In other words, the ionization current is lower during partial-load operation of the gas burner than during full-load operation of the gas burner. Moreover, the aging of the sensor has a different effect on the ionization signal during partial-load operation than during full-load operation.

According to the invention, the ionization signal is therefore detected at a first point of time during full-load operation I(1)NL and during partial-load operation I(1)TL, and for this first point of time a first difference D(1)=I(1)NL−I(1)TL is formed between the ionization signal during full-load operation and the ionization signal during partial-load operation. Furthermore, the ionization signal is detected at a second point of time during full-load operation I(2)NL and during partial-load operation I(2)TL, and for this second point of time a second difference D(2)=I(2)NL−I(2)TL is formed between the ionization signal during full-load operation and the ionization signal during partial-load operation. The first difference D(1) and the second difference D(2) are compared to each other, and, dependent thereon, the state of the gas burner, e.g. the state of the flame monitoring means or the sensor, is inferred, or the state of the gas burner is influenced.

The ionization signal is preferably determined at several successive points of time during full-load operation and partial-load operation. For each of these points of time a difference is formed between the ionization signal during full-load operation and the ionization signal during partial-load operation.

Dependent on a deviation between the differences of directly successive points of time, the state of the gas burner is then inferred, preferably the state of the gas burner is influenced.

It goes without saying that the degree of the partial load (e.g. 40% of the full load) as well as the full load are identical during the detection of the ionization signals for successive points of time.

In accordance with a deviation between the differences of successive points of time, the aging of the sensor supplying the ionization signal is inferred, with the degree of deviation being an indicator of the degree of aging of the sensor.

Dependent on the deviation between the above differences, a maintenance indication is activated which informs an operator that the sensor has to be exchanged. This preferably takes place when a threshold value of the deviation is exceeded. Dependent on this deviation, it can also be switched over to an emergency operation, in case of large deviations, the gas burner is preferably switched off.

In addition, the control of the gas burner can be adapted.

I claim:

1. A method for operating a gas burner using an ionization sensor supplying an ionization signal that is representative of a condition of operation of the gas burner, the method comprising:

during a first time period, detecting an ionization signal during full-load operation of the gas burner and detecting another ionization signal during a partial-load operation of the gas burner, the detected ionization signals having a first difference in signal;

during a second time period that is different than the first time period, detecting an ionization signal during full-load operation of the gas burner and detecting another ionization signal during a partial-load operation of the gas burner, the detected ionization signals having a second difference in signal; and determining a condition of operation of the gas burner as a function of a comparison of the first difference in signal with the second difference in signal.

2. The method of claim 1, wherein determining a condition of operation of the gas burner as a function of a comparison of the first difference in signal with the second difference in signal includes determining an age characteristic of the ionization sensor.

3. The method of claim 1, further comprising:

determining a threshold amount of deviation of the first and second differences from one another; and wherein determining a condition of operation of the gas burner as a function of a comparison of the first difference in signal with the second difference in signal includes determining a condition of operation of the gas burner as a function of the deviation of the first and second differences exceeding the determined threshold amount of deviation.

4. The method of claim 3, further comprising activating a maintenance indication as a function of the deviation of the first and second differences exceeding the determined threshold amount of deviation.

5. The method of claim 3, further comprising controlling the gas burner as a function of the deviation of the first and second differences exceeding the determined threshold amount of deviation.

6. The method of claim 5, further comprising deactivating the gas burner as a function of the deviation of the first and second differences exceeding the determined threshold amount of deviation.

7. The method of claim 1, further comprising controlling the gas burner as a function of the determined condition of operation of the gas burner.

8. The method of claim 1, wherein the full-load operation during the first and second time periods is about identical and wherein the partial-load operation during the first and second time periods is about identical.

9. A method for operating a gas burner arrangement including a gas burner, the method comprising:

providing an ionization sensor configured and arranged to generate an ionization signal that is representative of a condition of operation of the gas burner;

during a plurality of time periods, detecting ionization signals from the ionization sensor during full-load and partial-load operation of the gas burner;

for each time period, determining a difference between the ionization signals at full-load and partial-load operation; and determining a condition of operation of the gas burner as a function of a deviation, for successive time periods, in determined differences in ionization signals at full-load and partial-load operation.

10. The method of claim 9, further comprising determining a condition of operation of the gas burner as a function of a deviation in differences in ionization signals of full-load and partial-load operation for a plurality of the time periods.

11. The method of claim 9, further comprising controlling the operation of the gas burner as a function of the determined condition of operation of the gas burner.

12. The method of claim 9, further comprising:

determining a threshold amount of deviation in determined differences in ionization signals; and wherein determining a condition of operation of the gas burner as a function of a deviation includes determining a condition of operation of the gas burner as a function of the deviation in determined differences in ionization signals at full-load and partial-load operation for a successive time period exceeding the determined threshold amount of deviation.

13. The method of claim 12, further comprising controlling the operation of the gas burner in response to the deviation in determined differences in ionization signals at full-load and partial-load operation for a successive time period exceeding the determined threshold amount of deviation.

14. The method of claim 13, wherein controlling the operation of the gas burner in response to the deviation in determined differences in ionization signals at full-load and partial-load operation for a successive time period exceeding the determined threshold amount of deviation includes disabling the gas burner.

15. The method of claim 9, wherein determining a condition of operation of the gas burner as a function of a deviation includes determining a condition of operation of the ionization sensor.

16. The method of claim 9, wherein providing an ionization sensor configured and arranged to generate an ionization signal that is representative of a condition of operation of the gas burner includes providing the gas burner arrangement, the gas burner arrangement including the gas burner and the ionization sensor.

17. A method for detecting a condition of operation of an ionization sensor adapted to supply an ionization signal that is representative of a condition of operation of a gas burner, the method comprising:

during first and second time periods, detecting ionization signals from the ionization sensor during full-load and partial-load operation of the gas burner;

for each time period, determining a difference between the ionization signals at full-load and partial-load operation; and determining a condition of operation of the ionization sensor as a function of a deviation in the determined differences in ionization signals at full-load and partial-load operation between each time period.

18. The method of claim 17, further comprising:

controlling operation of the gas burner as a function of the determined condition of operation of the ionization sensor.

19. The method of claim 17, wherein determining a condition of operation of the ionization sensor as a function of a deviation in the determined differences in ionization signals at full-load and partial-load operation between each time period includes determining a condition of operation of the gas burner.

* * * * *